US010293234B1

(12) United States Patent
Schlegel

(10) Patent No.: US 10,293,234 B1
(45) Date of Patent: May 21, 2019

(54) IMPACT ABSORBING MECHANISM

(71) Applicant: Ohio State Innovation Foundation, Columbus, OH (US)

(72) Inventor: Anthony Schlegel, Worthington, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 143 days.

(21) Appl. No.: 15/212,764

(22) Filed: Jul. 18, 2016

Related U.S. Application Data

(60) Provisional application No. 62/193,197, filed on Jul. 16, 2015.

(51) Int. Cl.
*A63B 69/20* (2006.01)
*A63B 69/34* (2006.01)

(52) U.S. Cl.
CPC ..... *A63B 69/345* (2013.01); *A63B 69/20* (2013.01)

(58) Field of Classification Search
CPC ..... A63B 69/20–69/345; A63B 21/078
See application file for complete search history.

(56) References Cited

U.S. PATENT DOCUMENTS 1,548,849 A 8/1925 Ruden
2,253,758 A 8/1941 Bulloch
3,144,251 A 8/1964 Gainey et al.
3,218,070 A 11/1965 Crowther
3,237,944 A 3/1966 Kopp
3,329,428 A 7/1967 Moran
3,992,004 A 11/1976 Feron et al.
4,186,922 A 2/1980 Ketchum
4,239,209 A 12/1980 Curchod
4,262,901 A * 4/1981 Faust ..... A63B 21/078 482/104
5,072,932 A 12/1991 Johnson
5,277,679 A 1/1994 Wells
5,462,272 A 10/1995 Staten
5,474,290 A 12/1995 Rascona et al.
5,613,925 A 3/1997 Miasserian
5,651,755 A 7/1997 Chen
5,735,775 A 4/1998 Miasserian
6,685,581 B2 2/2004 Krause et al.
6,824,504 B2 11/2004 Ott
7,063,647 B2 6/2006 Harney et al.
7,329,210 B1 2/2008 Marano
7,452,294 B2 11/2008 Milone
7,699,756 B2 * 4/2010 Piane, Jr. ..... A63B 1/00 482/38
8,348,815 B2 1/2013 Signorino
8,534,672 B2 9/2013 Brune
8,747,287 B2 6/2014 Li
(Continued)

*Primary Examiner* — Jennifer M Deichl
(74) *Attorney, Agent, or Firm* — Jason H. Foster; Kremblas & Foster

(57) ABSTRACT

A portable, impact-absorbing apparatus having a striking portion, an energy-absorbing portion, and a mounting portion. The striking portion may be a padded plate and the mounting portion may be a collar that may mount to the vertical frame member of a squat rack. The energy-absorbing portion may be an insert that slides into the barrel of a hollow sleeve in which a spring is disposed. The sleeve may have slots in the top and bottom for bolts or pins, which are inserted therethrough for attachment to the insert, to define the longitudinal limits of the insert's extension.

6 Claims, 8 Drawing Sheets

(56) References Cited

U.S. PATENT DOCUMENTS

| | | | | |
|---|---|---|---|---|
| 8,790,198 | B1 | 7/2014 | Russell | |
| 2008/0026918 | A1 | 1/2008 | Lemke et al. | |
| 2009/0098985 | A1* | 4/2009 | Gonzalez ..... | A63B 69/004 482/83 |
| 2010/0216609 | A1 | 8/2010 | Merchant | |
| 2011/0118092 | A1 | 5/2011 | Keary, III et al. | |
| 2014/0128227 | A1 | 5/2014 | Ladas | |
| 2016/0101338 | A1 | 4/2016 | Daniels et al. | |

* cited by examiner

IMPACT ABSORBING MECHANISM

CROSS-REFERENCES TO RELATED APPLICATIONS

This application claims the benefit of U.S. Provisional Application No. 62/193,197 filed Jul. 16, 2015. The prior application is hereby incorporated by reference.

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

The invention relates broadly to fitness devices, and more particularly to devices for absorbing the impact of a user's strike.

It is well known that football players strike sleds, foam dummies and other practice equipment with their shoulders, hands and arms in order to simulate the impacts their bodies make with others during ordinary play. Most of the equipment used for this purpose is placed outdoors so that it can be used during the sport's season in an area where the sport is ordinarily played, and in a manner that simulates the ordinary play of the sport. However, football training takes place throughout the entire year, and in some climates it is not possible or safe to use such equipment throughout the entire year.

In many other sports and activities, including boxing and martial arts, athletes desire to strike an object while practicing or working out. Much of the equipment designed for this purpose is unsuitable, or is not able to be used widely for purposes different than its original purpose. Therefore, the need exists for an apparatus that can be struck by a user, and that is sufficiently modular that it can be mounted in virtually any environment, and particularly indoors.

BRIEF SUMMARY OF THE INVENTION

Disclosed herein is a device that may be used by athletes for various purposes. In particular, football players may use the device for hand strikes and hand placement in a weight room or any other indoor environment. The device may be mounted indoors to a squat rack frame, a horizontal or vertical post or beam in the gym or building, or any other stable structure, such as a wall, stair railing, or any member formed specifically to support the device or generally to support other structures.

The device has three main components: a mount, a target and an energy-absorber. The mount permits the device to be mounted to virtually any stable structure so that the entire device is supported when it is impacted with substantial force by a human user. When struck, the device will then move only in the designed manner, and it will return to its original position when the movement is completed. The target is engaged by the person using the device, and may be a padded plate, ball, cylinder, or other structure that is struck, pushed or otherwise engaged by the human user. The energy-absorber may be mounted between the mount and the target and converts the kinetic energy applied to the target by user to potential energy, preferably in the manner of compressing or expanding a spring. Thus, upon contact with the target, the energy-absorber is displaced and begins to store energy that is returned to displace the target to its original position upon release of the force, or at least release of some portion of the force, on the target.

One embodiment of the device has a mount that may be attached, such as by using a clamp or collar, to a stable structure, such as a squat rack member, horizontal or vertical beam, or wall, among others. The mount permits fixing of the device to a stable structure, and this can be by any convenient means. An energy-absorber may include a sleeve, which may be rigidly mounted to the mount, such as by welding. An insert of the energy-absorber extends telescopically into the sleeve and is mounted rigidly to a plate, which may be the target. The plate may be covered by a striking portion, such as a pad, to cushion the strike by the user.

The sleeve has slots on the top and bottom sidewalls through which pins, bolts or other structures, which are rigidly attached to the insert, extend to prevent the insert from sliding too far out of the sleeve. Of course, these orientations and directions may be reversed or otherwise modified as the person of ordinary skill will understand. A coil spring is mounted in a chamber formed within the sleeve, and seats at one end against the insert and at the opposite end against the mounting structure of the attachment. Upon movement of the insert into the outer member, the spring compresses and the pins slide in the slots. The insert stops upon reaching complete spring compression, impact of a pin with an end of a slot, or release of the striking force. Upon release of the force, the spring expands and forces the insert back to where the pin seats against the slots' ends.

Thus, described herein is a portable device used by football athletes to practice hand strike and hand placement, but which can be used by other athletes for various purposes. When the athlete engages, such as strikes or pushes, the pad with his hands at a sufficient force, the striking pad and insert extend into the sleeve and compress the spring. When the athlete releases his or her hands from the pad, the pad springs back to its original starting position under the force of the compressed spring.

The insert may be maintained in the sleeve by two bolts that prevent the apparatus from losing the spring tension. The bolts are preferably screwed into corresponding nuts that are welded inside the inner insert. The mounting portion can be made specifically to mount to any rack in a weight room or any other support structure, including a wall, to which the mount is bolted or screwed.

The insert and sleeve could be reversed with the sleeve mounted to the plate and the insert attached to the mounting structure. It is also contemplated that the sleeve may attach pivotably to the stable structure to allow the entire device to pivot upwardly with sufficient force applied. The spring may be replaced with a spring of a different stiffness so that the device may be customized for virtually any user.

Figure 1:
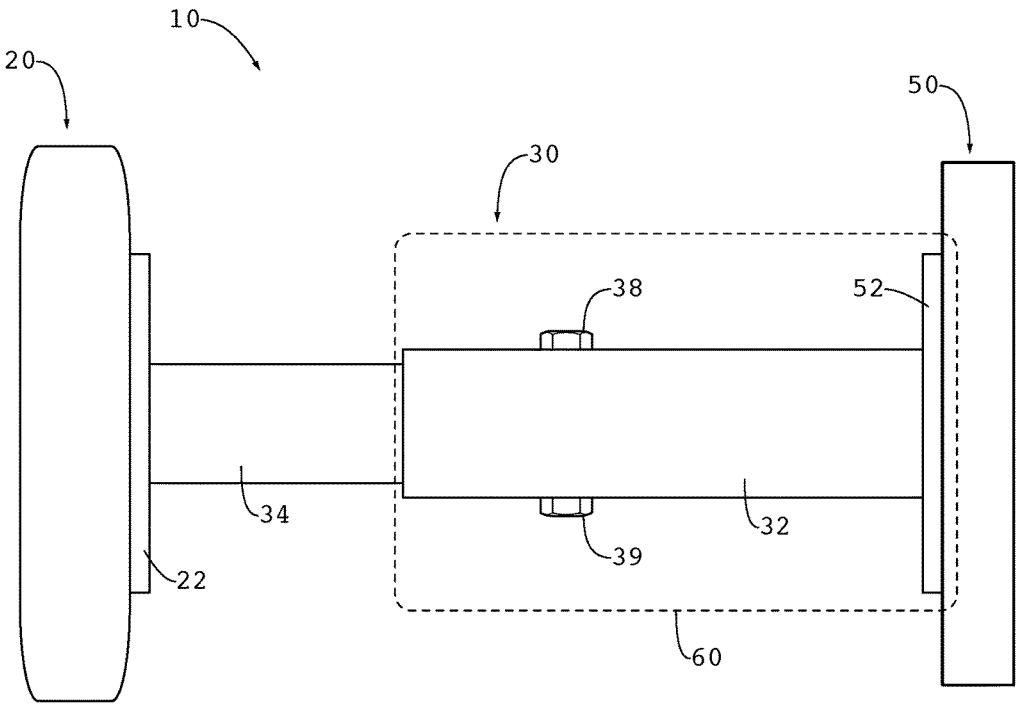
FIG. 1 is a top view illustrating an embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

U.S. Provisional patent application Ser. No. 62/193,197, which is the above claimed priority application, is incorporated in this application by reference.

The apparatus 10 shown in FIG. 1 includes a target or striking portion 20, an energy-absorbing portion 30, and a mount or mounting portion 50. In one embodiment, the mounting portion 50 is a collar rigidly attached to the plate 52, and the collar may clamp to a vertical post, such as that found on a squat rack, a horizontal post, such as a railing or weight bench, or any other free structure around which the collar may be fastened. The apparatus 10 may alternatively mount to a squat rack by fastening means currently used to mount a conventional structure to a vertical post of a squat rack. Thus, if safety bars are mounted to the squat rack's vertical members by inserting pins into horizontal holes, combined with a U-shaped bracket, such pins and U-shaped brackets are contemplated to serve as the mounting portion 50. Alternatively, the mounting portion 50 may include a plate to which a bracket, which may be U-shaped (see FIGS. 15 and 16) attaches from behind the vertical member of the squat rack or any other member. The bracket may be combined with any tightening means, including bolts, ratchet straps, or any other equivalent means, to clamp the plate to the bracket.

Figure 15:
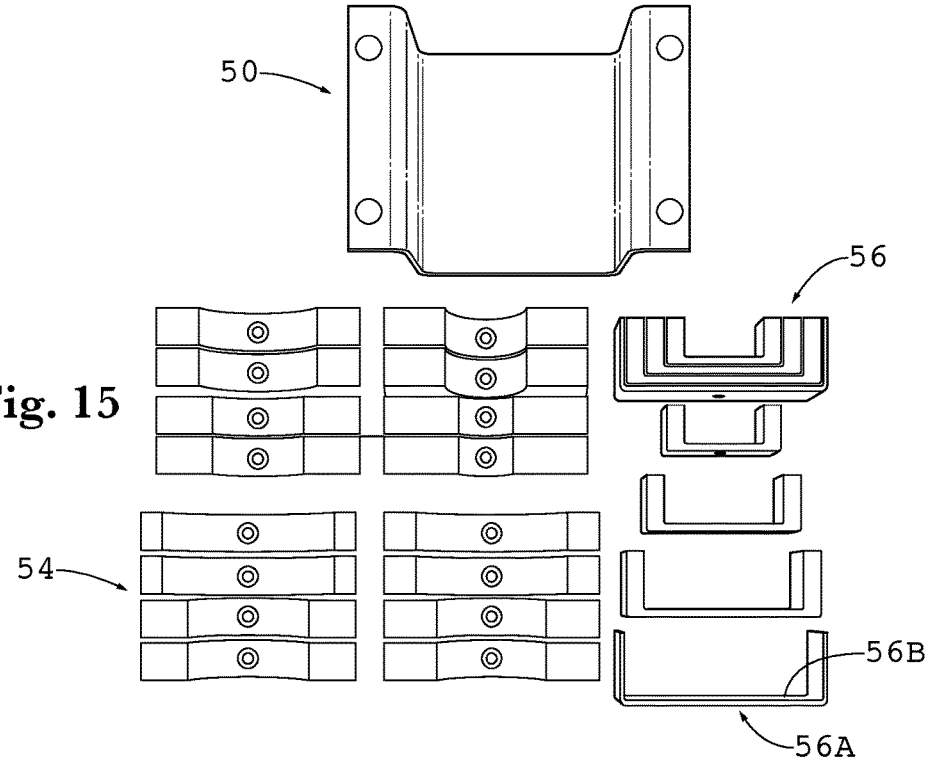
FIG. 15 is a top view illustrating components used to mount the present invention to a stable structure.
Figure 16:
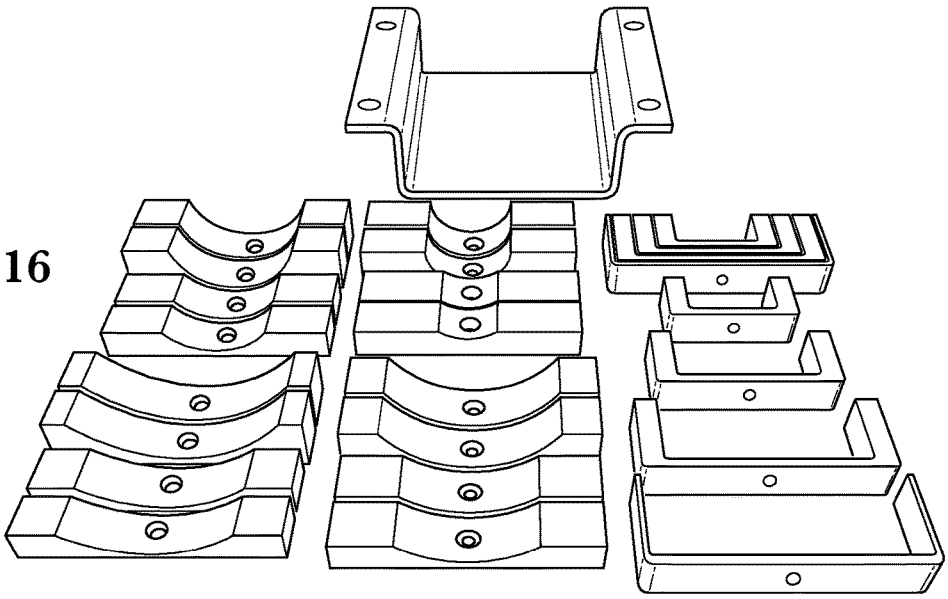
FIG. 16 is a view in perspective illustrating the components of FIG. 15.

It is contemplated to combine the mounting portion 50 with various adapters to ensure that the apparatus 10 may be combined with any shape or size of post, beam or member, including round and rectangular (e.g., square tubing) posts and beams. These may include plastic, or other strong but lightweight material, adapting members 54 and 56, as shown in FIGS. 15 and 16. The members 54 and 56 have a first surface that the mounting portion 50 receives tightly and an opposite surface that receives a post or beam of a smaller size, or a different shape, than the mounting portion 50. For example, the U-shaped adapting member 56 may fit between a U-shaped bracket that is a component of the mounting portion 50 and a rectangular post or beam (not shown) that has smaller sides than the mounting portion 50. The surface **56*a* seats against the mounting portion bracket and the oppositely-facing surface 56*b* seats against the smaller post or beam. If the apparatus 10 is to be mounted to a still smaller rectangular post or beam, multiple adapting members 56 may be nested within one another, as shown in FIG. 15**, to accommodate the smaller post or beam.

Alternatively, one of the round post or beam receiving adapting members 54 may fit between the rectangular mounting portion 50 and a round-shaped member or beam (not shown), such as a cylindrical pole. Alternatively, an adapting member of any shape may be used between any mounting portion and any stable structure member of a different shape. A variety of such adapting members may be included with the apparatus 10 to ensure a good fit with virtually any shape or size that may likely be encountered.

Any sufficiently strong horizontal, vertical or angled post will suffice to support the apparatus 10, and the mounting portion 50 includes any fastener that enables the apparatus 10 to mount rigidly to such a stable structure. In one embodiment, the mounting portion 50 is a sufficiently large plate 52 that may be mounted to a wall or other rigid structure, such as by extending screws (not shown) through apertures therein and into the wall. In another embodiment, (see FIG. 8) the mounting portion 50 includes a U-shaped bracket that slides around three sides of a square vertical member of a squat rack. A pin may be inserted into an aperture in the squat rack member. Another embodiment is bolted or otherwise clamped around to the vertical member.

In a preferred embodiment, the striking portion 20 is a padded plate, including without limitation a cushion, a rubber plate, an inflated pad or a pillow. The striking portion 20 could be a "half man" rubber dummy that is attached to the plate 22 or directly to the insert 34. The striking portion 20 can thus be any structure that a human can strike with his or her body or any tool, such as a bat, a helmet, or any other device. The striking portion 20 preferably deforms to increase the time over which the energy of the blow is imparted to the device, such as by at least partially elastically deforming. This is preferred in order to prevent or reduce injury to the user and/or damage to the striking portion 20. Of course, it is contemplated that each blow might cause wear to the striking portion 20 that over time requires the striking portion 20 to be replaced.

In a preferred embodiment, the energy-absorbing portion 30 includes a structure that receives the energy of the strike and deforms, compresses or otherwise reduces the distance between the striking portion's 20 surface facing the user and the mounting portion 50. Thus, the energy-absorbing portion 30 deforms along the length of the device. In the preferred embodiment, the energy-absorbing portion 30 is a telescopically-connected series of components with a spring that deforms under sufficient pressure. Alternatives include gas springs, elastomeric material, hydraulic mechanisms, leaf springs and any other energy-absorbing structure that deforms in the longitudinal direction to permit the striking portion 20 to be moved closer to the mounting portion 50.

Furthermore, the amount of energy that the striking portion 20 absorbs as it deforms to reduce the energy of the strike is very small in comparison to the energy absorption of the energy-absorbing portion 30. This is to ensure that the energy of the strike causes a perceptible movement of the entire striking portion 20 toward the mounting portion 50, rather than mostly a deformation of the striking portion 20, which may be less detectable by a human user. Thus, the pad may deform one-half inch while the energy-absorbing portion 30 may be displaced six inches.

In the embodiment of FIGS. 1-5, a sleeve 32 has a void therein, which is preferably an elongated, longitudinal barrel 44. An insert 34 slides in the barrel 44 with a small clearance between the outer surface of the insert 34 and the inner surface of the sleeve 32 to permit relatively free movement of the insert 34 within the sleeve 32. Low friction coatings or bearings may further reduce friction.

The striking portion 20 is disposed on one end of the insert 34, such as by mounting a padded board to the plate 22 that is rigidly fixed to the exposed end of the insert 34. The plate 22 may be welded to the insert 34 and the plate 52 may be welded to the sleeve 32. It is contemplated that the sleeve 32, the insert 34 and the plates 22 and 52 are made of steel, and the sleeve 32 and the insert 34 are steel square tubing. Other suitable substitute materials will become apparent to the person of ordinary skill from this description.

It will become apparent to the person of ordinary skill that the components that make up the energy-absorbing portion 30 may be reversed, so that the component attached to the plate 52 may be an insert, and the component mounted to the plate 22 may be a sleeve. Of course, the components may also be rotated relative to the position shown, with known effect and without changing the essential function of the device.

Figure 2:
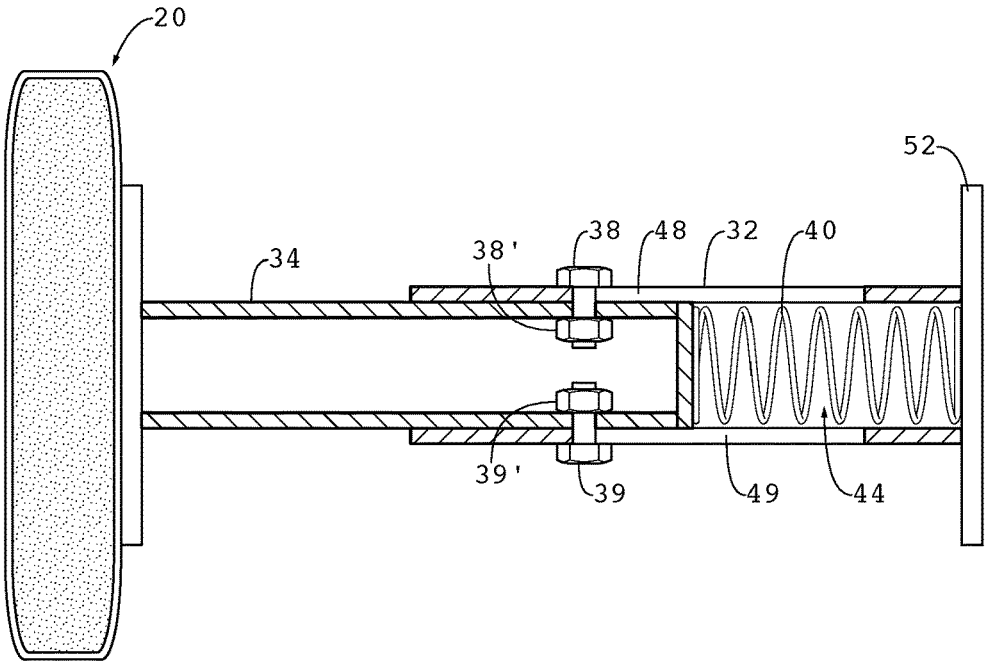
FIG. 2 is a top view in section illustrating the embodiment of FIG. 4 through the line 2-2.
Figure 3:
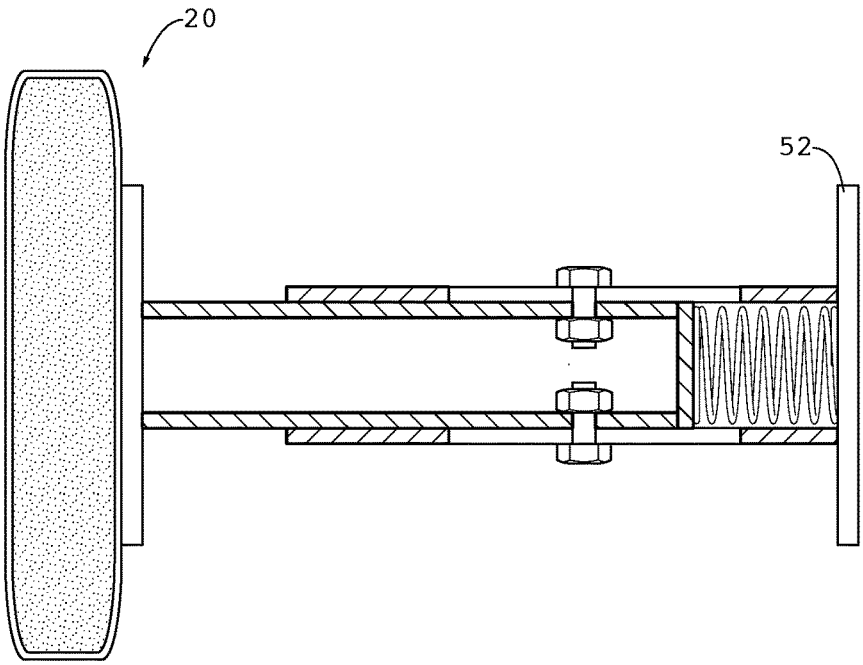
FIG. 3 is a top view in section illustrating the embodiment of FIG. 5 through the line 3-3.
Figure 4:
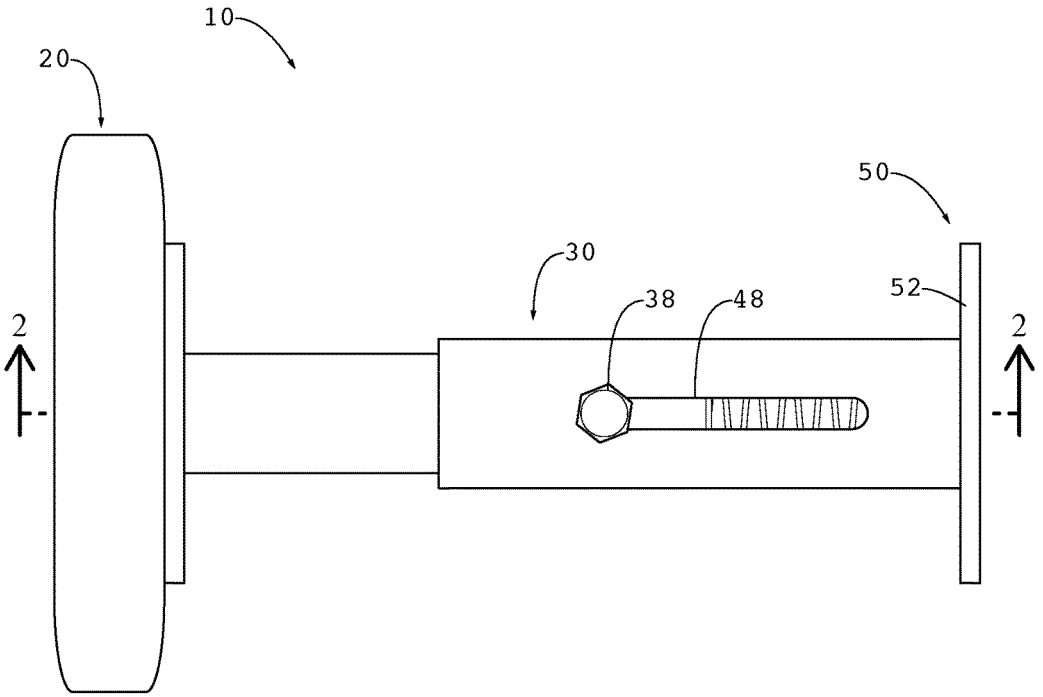
FIG. 4 is a side view illustrating the embodiment of FIG. 1 in an initial, uncompressed, state.
Figure 5:
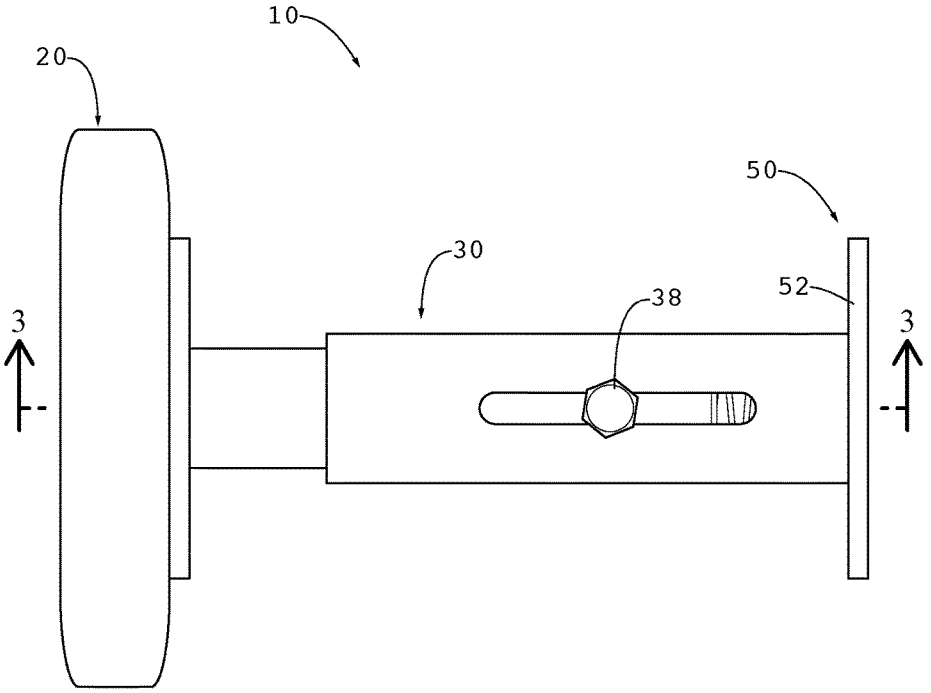
FIG. 5 is a side view illustrating the embodiment of FIG. 1 in a compressed state.

As shown in FIGS. 2 and 3, the insert 34 extends into the barrel 44 of the sleeve 32 and the outer surface of the insert 34 forms a sliding relationship with the inner sidewall of the sleeve 32, due to the small (e.g., 1.0 mm) gap formed therebetween. A spring may be disposed in the barrel 44, and may preferably be the coil spring 40, but could be any alternative spring including, but not limited to, a gas spring, a magnetic spring, and an elastomeric spring. The end of the insert 34 seats against a first end of the spring 40, and the second, opposite end of the spring 40 seats against the plate 52, which is preferably welded to the end of the sleeve 32. The spring 40 is preferably pre-compressed when the apparatus 10 is in its most elongated state, as shown in FIG. 2, and becomes further compressed when the striking portion 20 is pushed with enough force to overcome the resistive force of the spring 40, thereby causing the insert 34 to extend into the sleeve's barrel 44, such as to the position shown in FIGS. 3 and 5.

A pair of limiting guides, such as the bolts 38 and 39, extend into the insert 34, such as by threading into the nuts 38' and 39', respectively, that are fastened rigidly (such as by welding) to the interior of the insert 34. The bolts 38 and 39 preferably extend through the respective slots 48 and 49 and the apertures in the insert 34 that are aligned with the threaded apertures of the nuts 38' and 39'.

The shafts of the bolts 38 and 39 are shown in FIG. 2 in an initial position seated against the ends of the slots 48 and 49, respectively, that are closest to the striking portion 20 as forced there by the at least partially compressed spring 40. This is the position of the apparatus 10 when in a resting state, which is prior to the application of force by a user. Upon the application of a sufficient force to the striking portion 20 in the direction along the longitudinal axis of the insert 34, the spring 40 compresses farther as the insert 34 slides into the barrel 44 of the sleeve 32 to the position shown in FIGS. 3 and 5. The bolts 38 and 39 slide within the slots 48 and 49 as the insert 34 protrudes farther into the barrel 44, and may seat against the opposite ends of the slots 48 and 49 (not shown) to prevent over-compression of the spring 44 or impacting the plate 52. When the force of the impact ceases to overcome the expanding force of the spring 44, the spring 44 expands to return the insert 34 to the position shown in FIGS. 2 and 4 so that the striking portion 20 is in position for another impact.

Figure 13:
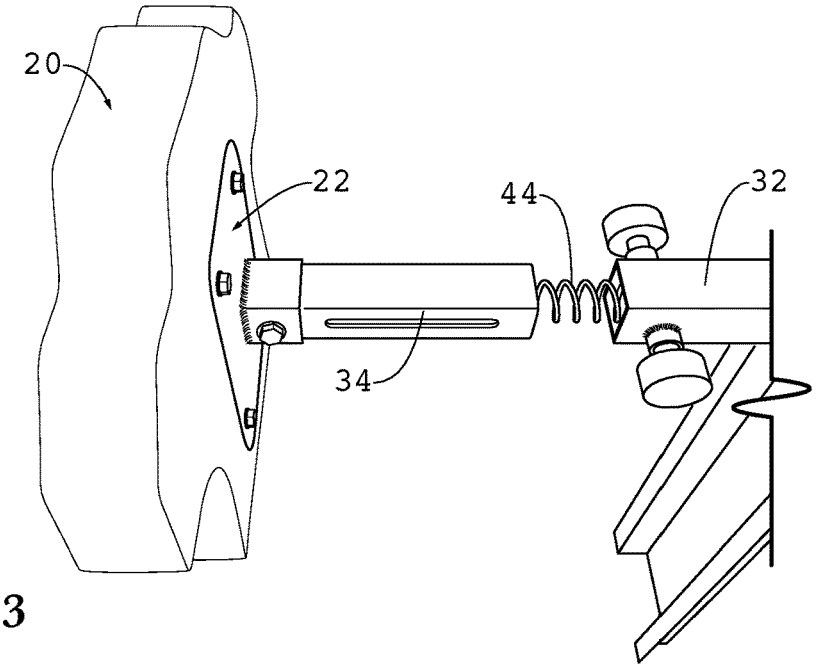
FIG. 13 is a view in perspective illustrating an embodiment of the present invention in a state of disassembly.
Figure 14:
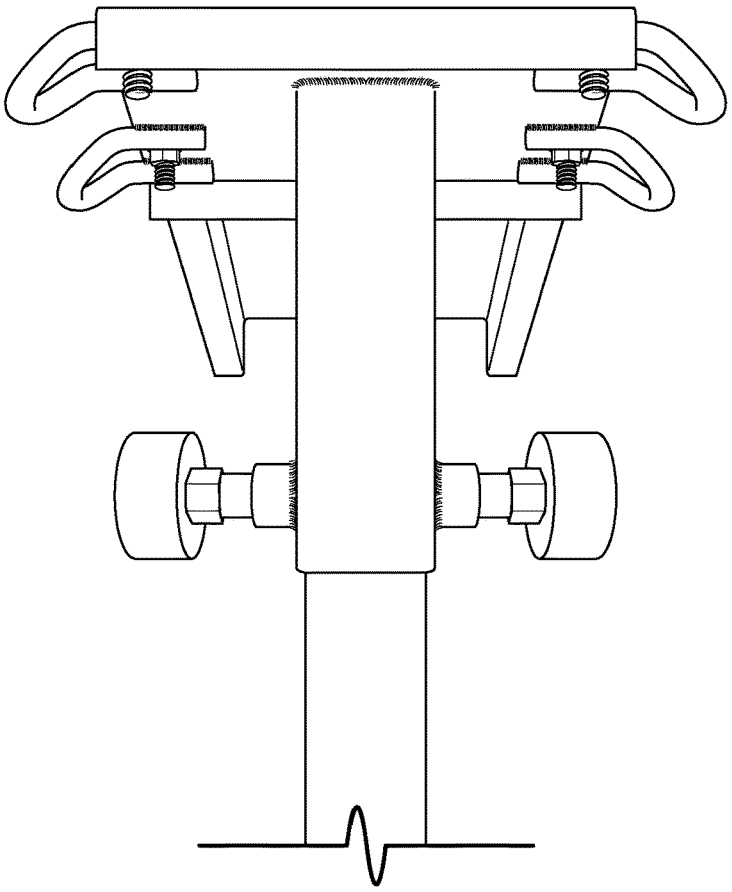
FIG. 14 is a top view illustrating an embodiment of the present invention.

In order to suit a user's preference or the purpose of its use, the apparatus's 10 spring 44 may be replaced with a spring having a higher stiffness (spring constant) or lower stiffness. In order to accomplish this, the bolts 38 and 39 are removed from the slots 48 and 49 and the insert 34 is withdrawn from the sleeve 32, as shown in FIG. 13. The spring 44 is then removed and replaced with the more desirable spring, at which time the insert 34 is replaced in the sleeve 32 and the bolts 38 and 39 are returned to the position shown in FIG. 2. It is also contemplated that the same spring 44 may be used, but it may be pre-compressed to a lesser or greater degree to provide the effect of a less or more stiff spring, at least during initial compression and expansion. One means for accomplishing this is a plurality of nuts welded along the length of the inside of the insert 34, in the same manner that the nuts 38' and 39' are attached. This series of spaced nuts permits a user to select which nuts to screw the bolts 38 and 39 into, and therefore the degree of pre-compression of the spring 44 when the shafts of the bolts seat against the ends of the slots. Alternative structures, such as a pull-pin that is common in weightlifting equipment to adjust which hole a pin is inserted into, that would accomplish the same purpose will become apparent to the person of ordinary skill. Pull-pins are shown in FIGS. 13 and 14, with a user's hands pulling the pull-pins laterally in FIG. 14 to permit removal of the insert from the sleeve without removal of bolts, which may result in loss of the bolts.

Figure 8:
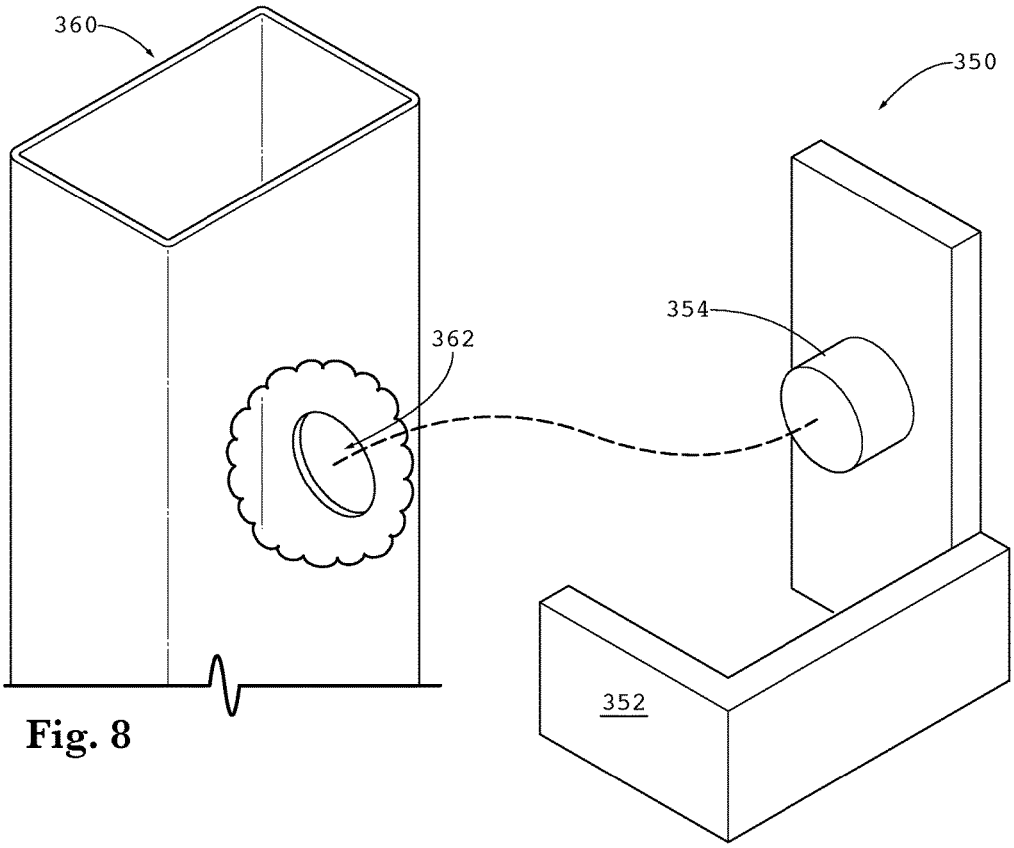
FIG. 8 is a schematic view in perspective illustrating a contemplated mount of the present invention to a squat rack vertical member.
Figure 9:
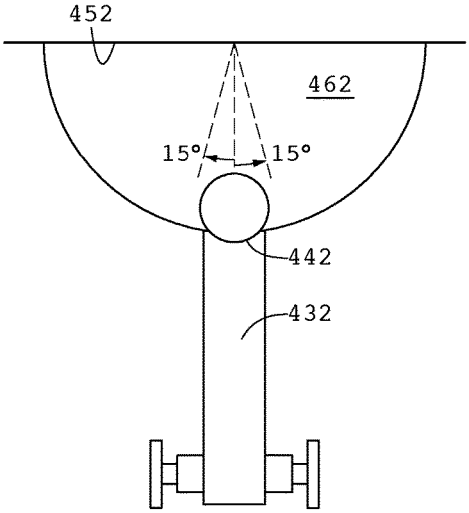
FIG. 9 is a schematic view illustrating a top view of an alternative embodiment of the present invention.
Figure 10:
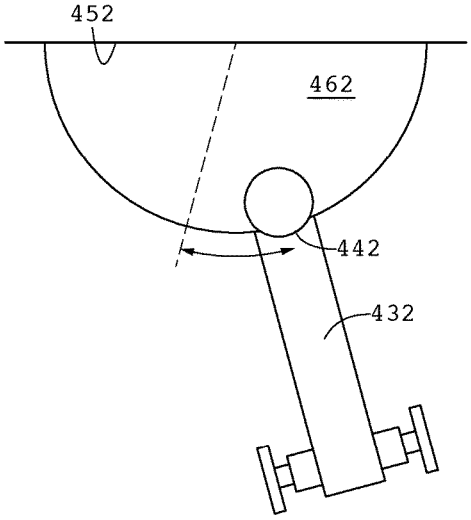
FIG. 10 is a schematic view illustrating a top view of the alternative embodiment of FIG. 9 in a different position.

As shown in FIG. 8 one contemplated mounting portion 350 is made specifically to attach to one of the vertical members 360 of a power rack (squat rack) in the same manner that the safety bars (the horizontal bars that catch a dropped barbell) mount to adjacent vertical members. In order to cooperate with such a squat rack, a steel plate is bent into a U-shaped collar 352 in combination with a pin 354 that extends into a slot or aperture 362 in the vertical member 360. It is contemplated to rigidly fix the mounting portion 350 of FIG. 8 to the plate 52, such as by welding or bolts, and permit mounting of the apparatus 10 to the squat rack's vertical member 360 as will become apparent to the person of ordinary skill from the description herein. Such collars may be mounted in one orientation to the plate 52, or they may be adjustable to permit mounting in various orientations so that the apparatus 10 may be mounted to protrude from any of the sides of the vertical posts of the squat rack that have apertures 362.

The apparatus 10 may be installed with its longitudinal axis oriented horizontally, as shown in FIGS. 1-5. The striking portion 20 may be positioned advantageously, such as at chest height if it will be used as a boxing or football hand-placement practice device. For example, a football player may lean over into a three-point stance, and then raise his body up to strike the striking portion 20 with his hands when a ball is snapped or a call is made to simulate a snap. Alternatively, the striking portion 20 may be positioned at waist height if it is to be kicked, or at knee or at any other suitable height if it is to be kicked in another manner. Because the apparatus 10 is removably mounted to a stable structure, it can be moved to any height permitted by the stable structure.

It will become apparent that the apparatus 10 can be mounted at any of various heights suitable for its intended purpose. The apparatus 10 can receive repetitive strikes on the striking portion 20 at any height by compressing the energy-absorbing portion 30 between the striking portion 20 and the mounting portion 50. Thus, once the apparatus 10 is mounted to a stable structure, it can be struck by a person's hands, feet, fingertips, elbows, knees, head, or any other body part or any object that the user uses to strike the striking portion 20, including, but not limited to, a helmet, a baseball bat, a boxing glove, a golf club, a hockey stick or any other instrument.

Upon the application of sufficient force, the insert 34 compresses the spring 44 and extends into the sleeve 32 as described above. When the force applied is released, or falls below the force necessary to maintain the spring 40 compressed, the insert 34 begins to be forced by the compressed spring out to its initial position. This application of force can be repeated until the user is finished or needs to move the apparatus 10 to a different position for a different workout.

It is contemplated that the plate 52 and the specific fastener that mounts the apparatus 10 to a stable structure can be readily separated, and the plate 52 can then be transported easily by hand and then mounted to a different fastener, for example a fastener that mounts the apparatus 10 to a different stable structure, possibly a structure that the original fastener would not sufficiently mount the apparatus to. Thus, the apparatus 10 is modular and portable so that one need not have a different combined striking portion 20 and energy-absorbing portion 30 for every kind of mounting portion 50 that is designed for a specific fastening function. Instead, one may transport a single apparatus 10 from one position to another, and from one location to another, by simply removing and carrying it. For example, one may have a mounting portion 50 that mounts to a wall, such as a plate with apertures for screws to fasten into. Additionally, one may have a particular brand of squat rack as described above and a mounting portion that is designed specifically to attach to the squat rack member. Such a mounting portion may include a collar that may be bolted to the plate 52. When desired, the collar may be attached to the plate 52 and the apparatus mounted to the squat rack member. When next desired, the collar may be removed and the plate 52 or a different plate may be used to bolt the combination of the striking portion 20 and energy-absorbing portion 30 to a wall, for example using concrete screws threaded into holes in a concrete wall. Once that use is completed, the plate 52 may be mounted to a different collar using bolts and the combination striking portion 20 and energy-absorbing portion 30 may be mounted to a different support, such as a cylindrical steel pole that supports a ceiling in a basement, using a mounting portion 50 that may include a U-bolt or other clamp. The adapters shown in FIGS. 15 and 16 may be used to securely mount the apparatus 10 to the stable structures described herein or any other that a person of ordinary skill will understand may be used.

In a preferred embodiment, the energy-absorbing portion 30 is about eighteen inches long with square steel tubes about two inches tall and wide. It is preferred to maintain a total length of about two feet and it is not desirable for the apparatus 10 to be much longer than this length, because the farther the user is away from the attachment point of the apparatus 10, the more leverage the user has, and thus may damage the mounting portion 50.

In a preferred embodiment, a plastic or other lightweight shield 60, shown in dashed lines in FIG. 1, extends around the slots 48 and 49 as an encircling housing to prevent injuries to hands or other body parts that could be extended into pinch points. The shield 60 also prevents people who are not knowledgeable about the apparatus 10 from attempting to maintain or repair the apparatus 10.

It is contemplated to use a computer, such as a smartphone, or a sensor to which a smartphone or other computer is connected, such as wirelessly, to measure the acceleration and other parameters of the moving striking portion 20. For example, an accelerometer or a force plate can be mounted to the plate 22 to connect wirelessly to a computer, such as the user's smartphone. During use, the acceleration data can be uploaded to the smartphone, which can display, after some calculations, the maximum acceleration of the striking portion 20, the maximum velocity, the maximum displacement, the distance travelled by the striking portion 20, the power of an impact, any differences between strikes, and any other information sought by the user that can be measured by any sensor.

One advantage to the apparatus described herein is that it can be mounted indoors, and therefore used all year round. The apparatus 10 is also maintained, such as when the spring must be removed, from the side or top. Conventional ROGERS brand football sleds are much larger and have a sliding bar that extends out of the back of the device. This prevents such mechanisms from being mounted as the invention is mounted—with the rear surface seated against a solid structure, such as a wall, so that the apparatus can be mounted with the striking force directed along a line that extends through the energy-absorbing portion 30 to the solid structure, rather than through a tube attached with an angled member as with the ROGERS brand football sleds. The fact that the energy-absorbing portion of the invention is along the longitudinal line connecting the engagement portion with the attachment portion means that the device is compact and moves by compressing the energy-absorbing portion between the engaging surface and the attachment portion.

The above-described and shown apparatus 10 is one embodiment of the present invention. Another embodiment is the apparatus 100 shown in FIG. 6, which is substantially identical to the apparatus 10 of FIG. 1, but with a pivot joint disposed between the plate 152 and the plate 160. The plate 160 may mount to a stable structure, such as a wall, squat rack member, or any other structure able to hold the apparatus 100. The members 154 and 156 are rigidly mounted to the plates 152 and 160, respectively, and may pivot relative to one another along a preferably horizontal axis through the rotating member 158. This permits the user to strike the striking portion 120 along the longitudinal axis of the apparatus 100, and such a strike will cause the apparatus 100 to operate as the apparatus 10 above. However, if there is a component of the strike force that is not along the longitudinal axis of the apparatus 100, such as an upwardly-directed force, the apparatus 100 may pivot about the rotating member 158, instead of, or in addition to, compressing longitudinally. It is preferred that a rotary or leaf spring (not visible) returns the apparatus 100 to the position shown in FIG. 6 after the force is released or reduced below that required to overcome the rotary or leaf spring at the rotating member 158.

Figure 6:
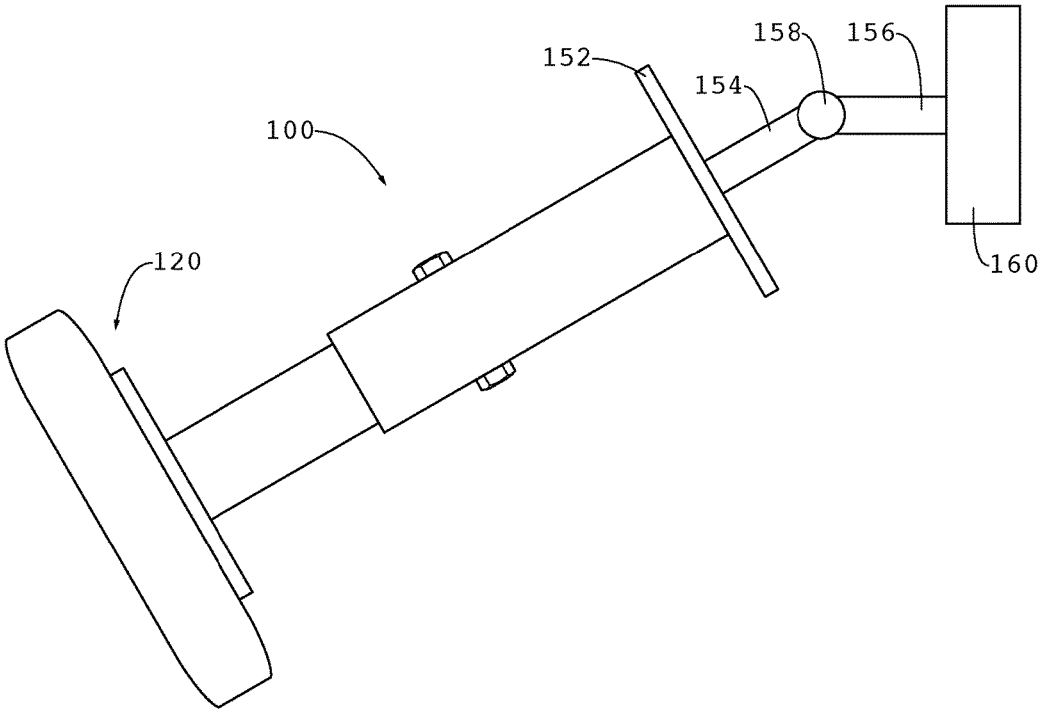
FIG. 6 is a top view illustrating an alternative embodiment of the present invention.
Figure 7:
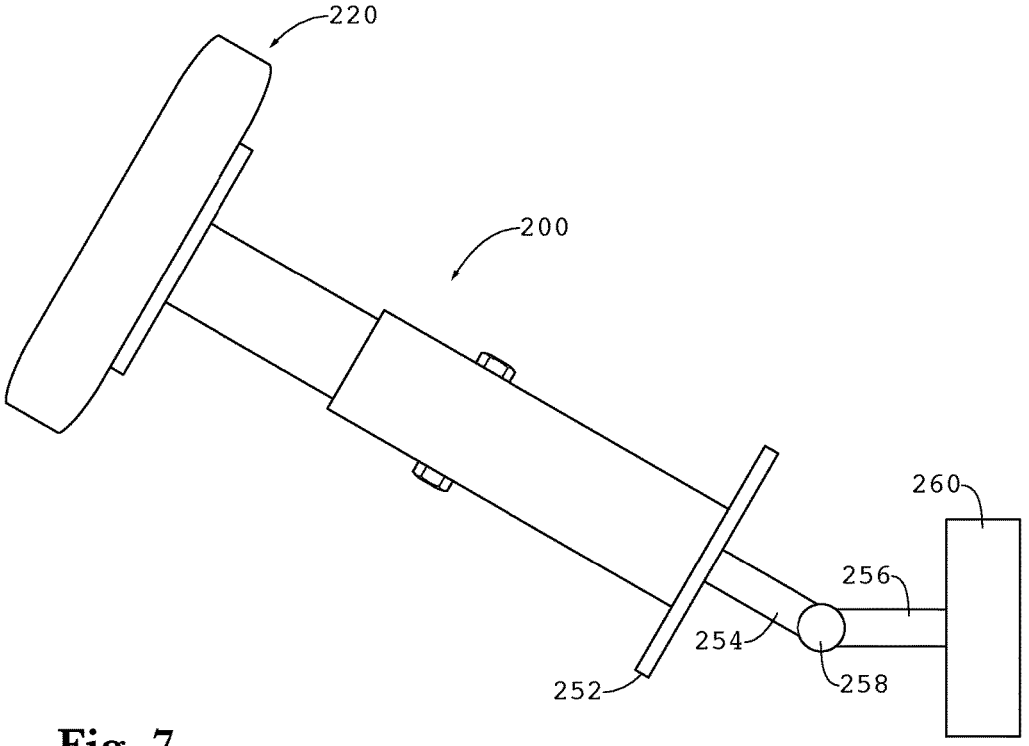
FIG. 7 is a top view illustrating an alternative embodiment of the present invention in an alternative position.

In an alternative embodiment, an apparatus 200 is shown in FIG. 7 that is substantially identical to the apparatus 100 of FIG. 6. The plate 260 may mount to a stable structure, such as a wall, squat rack member, or any other structure able to hold the apparatus 200. The members 254 and 256 are rigidly mounted to the plates 252 and 260, respectively, and may pivot relative to one another along a preferably horizontal axis through the rotating member 258. This permits the user to strike the striking portion 220 along the longitudinal axis thereof. However, if there is a component of the strike force that is not along the longitudinal axis of the apparatus 200, such as a downwardly-directed force, the apparatus 200 may pivot about the rotating member 258, instead of, or in addition to, compressing longitudinally. It is preferred that a rotary or leaf spring (not visible) returns the apparatus 200 to the position shown in FIG. 7 after the force is released or reduced below that required to overcome the rotary spring at the rotating member 258.

The embodiments of FIGS. 6 and 7 could be used during practicing for boxing or mixed martial arts (MMA), and they could be used in a "fitness fighting" (aerobics-martial arts) workout, whether pivoting up or pivoting down. Other uses will become apparent, and other orientations will become apparent as well, including pivoting horizontally rather than, or in addition to, vertically.

Figure 11:
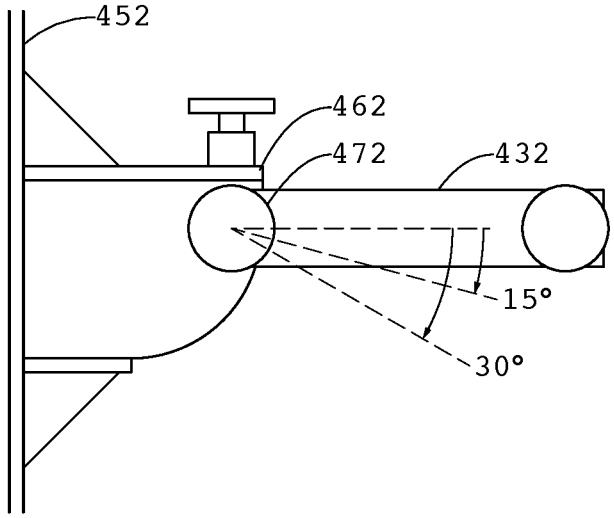
FIG. 11 is a schematic view illustrating a side view of an alternative embodiment of the present invention.
Figure 12:
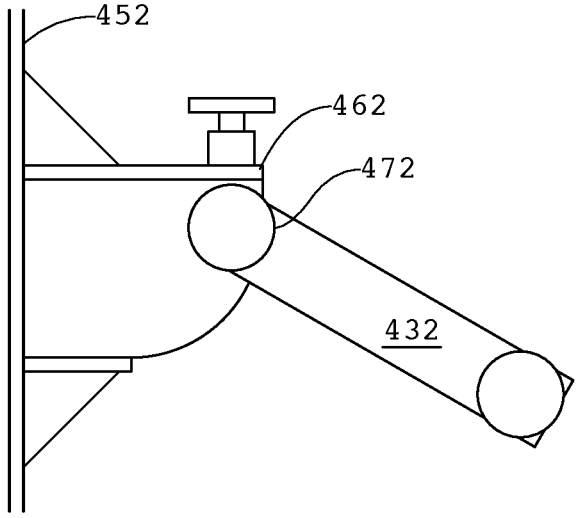
FIG. 12 is a schematic view illustrating a side view of the alternative embodiment of FIG. 11 in a different position.

The alternative embodiments of FIGS. 9-12 show vertical and horizontal adjustments to embodiments of the invention. The sleeve 432 is pivotably attached to the mounting portion 452 by the plate member 462 into which the pull-pin 442 removably inserts. The sleeve may be rotated laterally from the position shown in FIG. 9 to the position shown in FIG. 10 by simply withdrawing the pull-pin 442, displacing the sleeve 442 laterally, and then releasing the pull-pin 442 to insert into the plate member 462, which laterally locks the sleeve 432 into this position. In FIGS. 11-12, the sleeve 432 is displaced vertically by withdrawing the pull-pin 472 laterally, displacing the sleeve 432 horizontally and then releasing the pull-pin 472 to insert into a member (not shown) that locks the sleeve 432 into this position horizontally.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A strike-absorbing apparatus for receiving a strike from a person, the apparatus comprising:

(a) a striking portion configured to receive strikes;

(b) a mounting portion removably mounted to a substantially vertical post of a squat rack having at least one aperture; and (c) an energy-absorbing portion disposed between, and mounted to, the striking portion and the mounting portion, wherein an elongated insert extends slidably into a barrel formed in an elongated sleeve, wherein the barrel defines a chamber in which a spring is mounted for compression when the elongated insert extends into the barrel, wherein the striking portion mounts at a first end of the energy-absorbing portion, and the mounting portion mounts at a second, opposite end of the energy-absorbing portion, wherein the mounting portion includes:

(i) a plate that seats against a first side of the vertical post;

(ii) a bracket that is disposed adjacent a second, opposite side of the vertical post and removably mounts to the plate, thereby clamping the vertical post between the plate and the bracket; and (iii) an adapting insert that is disposed between the bracket and at least the second side of the vertical post to seat against the second side.

2. The apparatus in accordance with claim 1, wherein the vertical post has a substantially circular cross section, and at least one face of the adapting insert that seats against the vertical post is curved.

3. The apparatus in accordance with claim 1, wherein the vertical post has a rectangular cross section, and at least one face of the adapting insert that seats against the vertical post is flat.

4. The apparatus in accordance with claim 3, wherein the adapting insert further comprises a plurality of U-shaped structures nested within one another.

5. The apparatus in accordance with claim 1, wherein the bracket is configured to separate from the plate to permit removal of the apparatus from the vertical post.

6. A strike-absorbing apparatus for receiving a strike from a person, the apparatus comprising:

(a) a striking portion configured to receive strikes;

(b) a mounting portion removably mounted to a substantially vertical post of a squat rack having at least one aperture; and (c) an energy-absorbing portion disposed between, and mounted to, the striking portion and the mounting portion, wherein an elongated insert extends slidably into a barrel formed in an elongated sleeve, wherein the barrel defines a chamber in which a spring is mounted for compression when the elongated insert extends into the barrel, wherein the striking portion mounts at a first end of the energy-absorbing portion, and the mounting portion mounts at a second, opposite end of the energy-absorbing portion, wherein the mounting portion includes:

(i) a plate that seats against a first side of the vertical post; and (ii) ratchet straps removably mounted to U-shaped members that are attached to the plate and disposed adjacent a second, opposite side of the vertical post for clamping the plate to the vertical post.

* * * * *